United States Patent [19]

Heywood

[11] 4,193,599

[45] Mar. 18, 1980

[54] REEL SPINNING AND STOPPING DEVICES

[75] Inventor: Joseph R. Heywood, Kingsgrove, Australia

[73] Assignee: Heywood Design Pty. Ltd., Kingsgrove, Australia

[21] Appl. No.: 960,479

[22] Filed: Nov. 13, 1978

[51] Int. Cl.[2] ..... A63F 5/04

[52] U.S. Cl. ..... 273/143 R

[58] Field of Search ..... 273/143 R, 143 A, 143 B, 273/143 C, 143 D, 143 E, 138 R, 138 A; 194/DIG. 11, DIG. 12, DIG. 13; 74/17.5

[56] References Cited

U.S. PATENT DOCUMENTS

| | | | |
|---|---|---|---|
| 1,767,602 | 6/1930 | Mills | 273/143 R |
| 2,035,084 | 3/1936 | May | 273/143 R |
| 2,555,010 | 5/1951 | Schnabolk | 273/143 R |
| 2,641,473 | 6/1953 | Stalter | 194/DIG. 11 X |
| 3,209,883 | 10/1965 | Hopps | 273/143 R X |
| 3,747,936 | 7/1973 | Ohki | 273/143 R |
| 3,759,525 | 9/1973 | Davis | 273/143 R |

FOREIGN PATENT DOCUMENTS

| | | | |
|---|---|---|---|
| 224253 | 10/1958 | Australia | 273/138 A |

*Primary Examiner*—Richard C. Pinkham
*Assistant Examiner*—Arnold W. Kramer

[57] ABSTRACT

An improved reel spinning and stopping means for use in devices of the kind in which a number of reels carrying representations of symbols, letters, numbers or other indicia on their peripheries are assembled linearly spaced alongside each other and are free to rotate independently of each other as in slot machines, coin freed amusement devices and the like wherein each reel has associated with it a toothed sprocket having one tooth for each symbol represented on the periphery of the reel, spinning and stopping the reel being effected by a pawl means engageable between any pair of the teeth of the toothed sprocket, solenoid control means controlling the engagement of the pawl with the sprocket, spinning means arranged to cause the pawl to rotate the toothed sprocket and rotatable cam means arranged to cause the pawl to re-engage the sprocket and thus stop rotation of the reel are provided.

3 Claims, 5 Drawing Figures

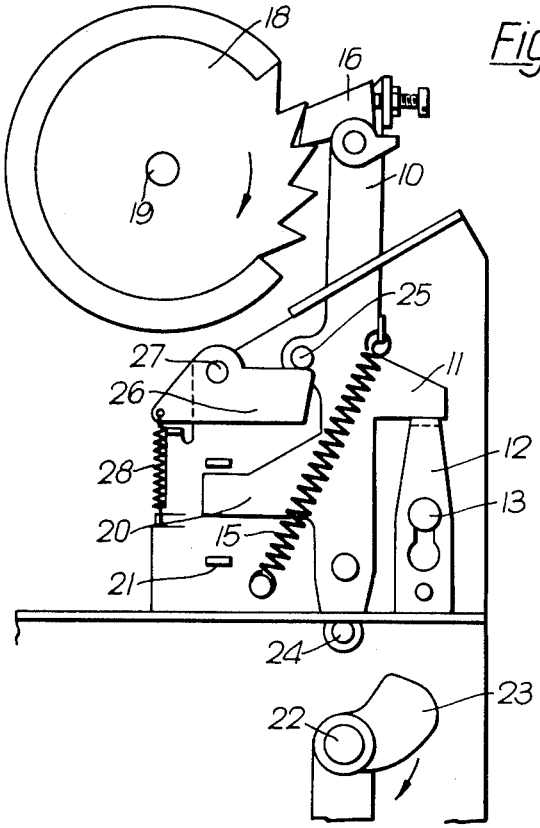
Fig. 1.
Fig. 1a.
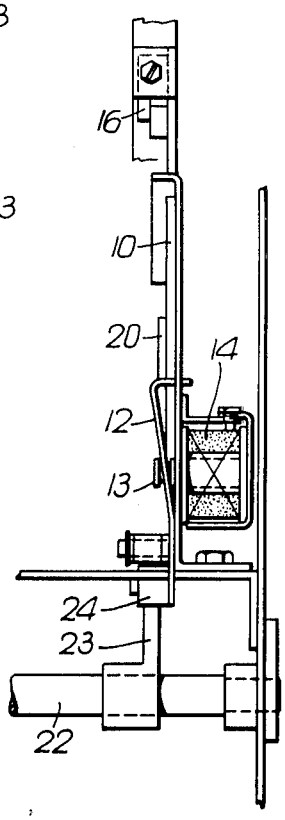

REEL SPINNING AND STOPPING DEVICES

The present invention relates to an improved reel spinning and stopping means for use in devices of the kind (hereinafter referred to as the kind set forth) in which a plurality of reels carrying representations of symbols, letters, numbers or other indicia on their peripheries are assembled linearly spaced alongside each other and are free to rotate independently of each other. Such an arrangement is useful in machines of the kind variously known as poker machines, fruit machines or slot machines and also in coin freed amusement devices, advertising devices and random or pseudo-random number generators.

The present invention provides a means of spinning these reels simultaneously (or separately) and a means of stopping them in any desired sequence. It also provides a means of not spinning one or more reels when required in such model variations generally known as "hold and draw" types.

The present invention consists in a device in which a plurality of reels carrying representations of symbols, letters, numbers or other indicia on their peripheries are assembled linearly spaced alongside each other and are free to rotate independently of each other wherein each reel has attached to its side and concentric with its axis a toothed sprocket having one tooth for each symbol represented on the periphery of the reel, of means mounted adajcent each reel for both spinning the reel and stopping it including pawl means engageable between any pair of teeth of the toothed sprocket, lever means to which said pawl means is attached, solenoid controlled trigger means arranged to hold said lever means in a position in which said pawl means in engaged with the toothed sprocket, spring means arranged to cause said pawl means to move to rotate the toothed sprocket on actuation of said solenoid controlled trigger means, means to disengage said pawl means from said toothed sprocket and rotatable cam means arranged to restore said lever means and said pawl means to said position to stop rotation of said toothed sprocket. Preferably means are provided to control restoration of the pawl means with the sprocket so that this occurs with a sharp and positive action.

The construction of devices of the kind set forth, for example, slot machines is well known in the art and it is thus necessary to illustrate and describe only those parts relevant to the present invention.

Figure 2:
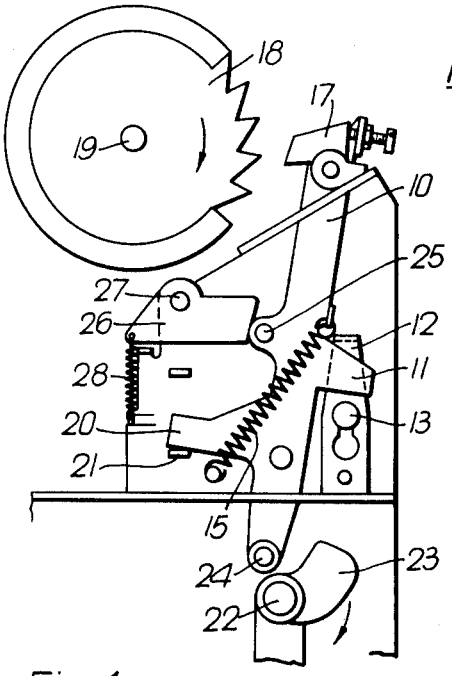
Figure 3:
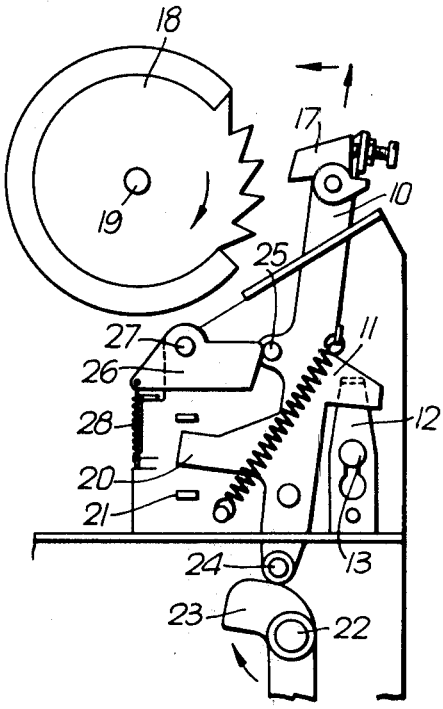
Figure 4:
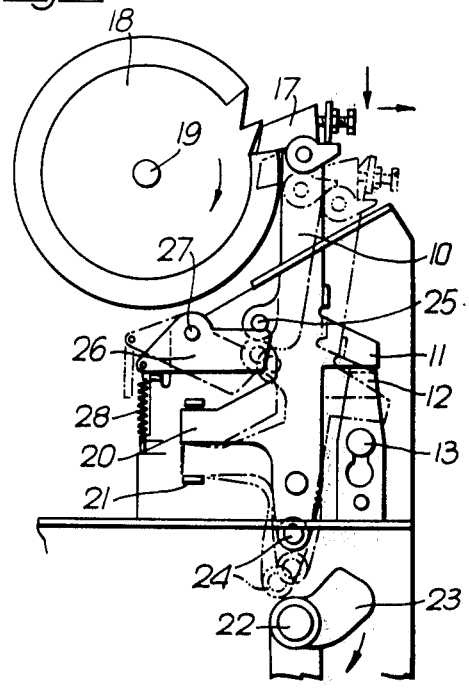

In order that the nature of the invention may be better understood a preferred form thereof incorporated in a slot machine is hereinafter described by way of example with reference to the accompanying drawings in which:

FIG. 1 is a side elevation of apparatus according to the invention with pawl means in the form of a stopper head engaged with the toothed sprocket, FIG. 1*a* is a view taken from the right and looking to the left in FIG. 1, FIG. 2 is a view similar to FIG. 1 showing a reel spinning and the pawl means withdrawn, FIG. 3 is a similar view with the pawl means on the way up to the stop position, and FIG. 4 is a similar view illustrating the completion of the cycle of movement of the pawl means.

In the position in FIG. 1 the pawl means constituted by the stopper arm 10 is held in the engaged, i.e. "stopped" position by virtue of its upper horizontal integral leg 11 resting on the top face of the stopper arm release lever 12 (see FIG. 1*a*).

To commence a game it is necessary to spin the reels, usually simultaneously, and to achieve this with the present invention is extremely simple. The stopper arm release lever 12 is connected to a solenoid armature 13 (FIG. 1*a*) and therefore when the solenoid 14 is energised the release lever 12 is moved inwards towards the solenoid 14.

This movement removes the support from under the upper horizontal leg 11 of the stopper arm 10 allowing it to drop under the influence of the stopper arm spring 15. The sharp vertical downwards movement of the stopper amr 10 causes the stopper head 16, which is engaged with the teeth of the toothed sprocket 18 attached to the reel (not shown), to give the sprocket a sharp pull or kick which causes the reel to spin on its axle 19. In order to disengage the stopper head 16 at the end of its vertical stroke to allow the reel to spin freely the lower integral leg 20 of the stopper arm hits the lower limit stop 21. this causes the stopper head 17 to move away from the toothed sprocket 18 and therefore disengage from it. (See FIG. 2).

Mounted immediately below the stopper arm 10 is a camshaft 22, which is either electrically or mechanically driven, which has a series of cams such as 23 attached to it. Each cam 23 being so positioned that it is in line with a roller 24 mounted on the lower end of each stopper arm 10. After a predetermined time has elapsed, the cam 23 rotates, engages the roller 24 and moves the stopper arm 10 upwards. A pin 25 mounted on the stopper arm now comes into engagement with the front face of the trip lever 26 (see FIG. 3). On the way down the stopper arm pin 25 trips over the trip lever 26 because it is pivoted at 27 and spring loaded by the spring 28 in such a was as to allow this (see FIG. 4).

As the stopper arm 10 is moved upwards by the cam 23 the engagement of the pin 25 against the face of the trip lever 26 keeps the stopper arm head 17 from engaging with the toothed sprocket 18 attached to the reel until it is almost at the top of its stroke. (FIG. 3). When the stopper arm 10 reaches a position where the pin 25 can go over the top of the trip lever 26 the stopper arm 10 is pulled towards the toothed sprocket 18 under the influence of the stopper arm spring 15 causing the stopper arm head 17 to again engage the toothed sprocket 18 and so to stop the reel from spinning. At the same time the upper horizontal leg 11 of the stopper arm has been lifted above the stopper arm release lever 12. This lever, now no longer under the influence of the solenoid, springs back under the horizontal leg 11 and prevents the arm from dropping again until the next game.

The cams 23 are so arranged on the camshaft 22 that during one complete cycle of the camshaft all the stopper arms operate in the desired sequence to stop all the reels in turn.

The reason for the delay in allowing the stopper head to re-engage with the spinning toothed sprocket on the return stroke is to achieve a sudden engagement rather than a gradual one. This achieves a sharp and positive stopping action of the reel which is a desirable feature on a poker machine.

When a "hold and draw" feature is required, that is the ability to prevent one or more reels spinning when commencing a game, this is achieved by simply not energising the appropriate solenoids which prevents those reels from getting the necessary "kick" to spin them.

Points of note in connection with the invention are:

1. That the same arm that is used for spinning the reels is also used for stopping them.

2. The operation of the stopper arms is such that a very powerful "kick" or pulse can be given to spin the reel with a very low powered solenoid.

3. That the provision of the "hold and draw" ability is provided without any further mechanism or cost.

4. The complete stopper arm assembly is compact and cheap to produce and because it is in itself a complete module any number of reels can be operated by simply adding a stopper module.

5. Being a complete module in itself it requires no complicated inter-connection with the rest of the machine to cause it to be operated at the right time other than the provision of a cam to reload it.

I claim:

1. A device in which a plurality of reels carrying representations of symbols, letters, numbers or other indicia on their peripheries are assembled linearly spaced alongside each other and are free to rotate independently of each other wherein each reel has attached to its side and concentric with its axis a toothed sprocket having one tooth for each symbol represented on the periphery of the reel, the provision of means mounted adjacent each reel for both spinning the reel and stopping it including pawl means engageable between any pair of teeth of the toothed sprocket, lever means to which said pawl means is attached, solenoid controlled trigger means arranged to hold said lever means in position in which said pawl means is engaged with the toothed sprocket, spring means arranged to cause said pawl means to move to rotate the toothed sprocket on actuation of said solenoid controlled trigger means, means to disengage said pawl means from said toothed sprocket and rotatable cam means arranged to restore said lever means and said pawl means to said position to stop rotation of said toothed sprocket.

2. A device as claimed in claim 1 wherein means are provided to control the movement of said lever means during restoration to said position whereby engagement of said pawl means with said toothed sprocket occurs with a sharp and positive action.

3. A device as claimed in claim 2 wherein said last mentioned means includes a trip lever having a face against which part of said lever means is held by said spring means during restoration of said lever means to said position with said pawl means clear of the toothed sprocket, the trip lever being shaped so that on said part of said lever means passing said face it is immediately released to enable said pawl means to be brought into engagement with said toothed sprocket under the influence of said spring means.

* * * * *